US011787614B2

(12) United States Patent
Kuitunen

(10) Patent No.: US 11,787,614 B2
(45) Date of Patent: Oct. 17, 2023

(54) PACKAGE AND A METHOD FOR PREPARING A PACKAGE

(71) Applicant: Sartorius Biohit Liquid Handling Oy, Helsinki (FI)

(72) Inventor: Tuomas Kuitunen, Helsinki (FI)

(73) Assignee: Sartorius Biohit Liquid Handling Oy, Helsinki (FI)

( * ) Notice: Subject to any disclaimer, the term of this patent is extended or adjusted under 35 U.S.C. 154(b) by 283 days.

(21) Appl. No.: 17/203,873

(22) Filed: Mar. 17, 2021

(65) Prior Publication Data

US 2021/0292068 A1 Sep. 23, 2021

(30) Foreign Application Priority Data

Mar. 17, 2020 (EP) ..... 20163629

(51) Int. Cl.
*B65D 75/58* (2006.01)
*B01L 9/00* (2006.01)
*B65D 75/12* (2006.01)

(52) U.S. Cl.
CPC ..... *B65D 75/5805* (2013.01); *B01L 9/543* (2013.01); *B65D 75/12* (2013.01)

(58) Field of Classification Search
CPC . B01L 5/543; B01L 9/543; B01L 9/00; B65D 75/12; B65D 75/58; B65D 75/5805
USPC ..... 206/370, 438; 383/207–209
See application file for complete search history.

(56) References Cited

U.S. PATENT DOCUMENTS 5,441,702 A * 8/1995 Lemieux ..... B65D 71/70 206/563
5,620,095 A * 4/1997 Delmore ..... B65D 75/58 383/201
5,984,088 A * 11/1999 Dietz ..... B65D 75/58 383/201
2015/0158628 A1 6/2015 Walsh
2016/0176599 A1* 6/2016 Hanus ..... B65D 75/5805 383/209
2017/0233159 A1* 8/2017 Cruz ..... B65D 75/5805 206/484.2

FOREIGN PATENT DOCUMENTS

WO WO9216431 A1 10/1992

* cited by examiner

*Primary Examiner* — Bryon P Gehman
(74) *Attorney, Agent, or Firm* — Laine IP Oy

(57) ABSTRACT

According to an aspect of the present invention, there is provided a package comprising: a sheet of flexible film material folded along a longitudinal direction to bring edges of the sheet together, the edges being sealed to form a longitudinal rear seam; a first end of the folded sheet is sealed by a first end seam, and a second end of the folded sheet is sealed by a second end seam to form a space for items, wherein said space is defined by the sealed ends and a side wall formed of the folded sheet; an opening initiation point in one of the end seams, the opening initiation point configured to provide a point for initiating tearing of the flexible film material to form an opening; a tear control element configured to guide tearing initiated from the initiation point along a longitudinal direction, from the first end seam to the second end seam and across the sidewall, upon applying a tearing force.

18 Claims, 4 Drawing Sheets

PACKAGE AND A METHOD FOR PREPARING A PACKAGE

FIELD

The present invention relates to packages made of flexible material, and more particularly packages that comprise means for controlling opening of the package by tearing.

BACKGROUND

When packaging products that require a high and controlled purity or sterilization level, attention shall be paid not only to the product package itself but also its manufacturing and opening processes. The package must keep the product uncontaminated through the entire logistics chain. The end user shall obtain the product from the package to an end use situation without any risk of contamination.

Typically, purity of products requiring a controlled purity level is ensured by packaging the products to packages made of plastic film. Such packages prevent contamination of the product located inside the package. Such packages are manufactured for example by flow wrap, shrinkwrap and TFFS (Thermoform-Fill-Seal) methods. In flow wrap and shrinkwrap methods, a kind of bag is formed around the product. In the TFFS method, a package base with a desired shape is moulded, the product is placed on the base, and finally a film is sealed onto the base to close the package.

Each of these methods has disadvantages. For example, in a shrinkwrap film there are holes through which air can escape from the bag during the manufacturing process. Such holes clearly expose the product to a risk of contamination.

In the TFFS method, the forming of the base of the package imposes restrictions to the dimensions of the package, such as its depth in relation to the area. A package manufactured by the TFFS method typically takes more space than a pouch-type package. If the base has been formed from a rigid film, the packaging waste will also require a lot of space.

The flow wrap method is a very widely used method for packaging products that require a controlled purity and sterility level. A major disadvantage of this method is that the package is difficult to open in a controlled manner. Typically a flow wrap bag comprises an opening initiation point in one of the seams, from which tearing of the bag is started. Tearing starts easily but progresses in an uncontrolled manner to various directions, depending on tearing forces and directions that are used. In the worst case, only a tiny corner is detached upon the first tearing action, thus necessitating further attempts to tear the bag open.

It is known to attach tear strips onto the film material of a package. Such strips are usually made of a plastic material and glued onto the film material of the package. The strips function so that the user grasps an end of the strip located in a seam of the package and tears the strip off the film material, whereby the film material is also torn under the strip. A disadvantage of such tear strips is the limited strength of the glued joint between the strip and the film material. The force required to tear the film material beneath the strip is relatively high, particularly when the package is made of a multilayer laminate film ensuring good barrier properties, and therefore the strip may become detached and the film left unopened.

Another disadvantage of tearing strips is that the adhesive that is used for attaching the strip to the film material is located inside the package, which clearly exposes the product to a potential source of contamination.

It is known to use oriented plastic film materials that tend to tear along a certain direction. Such a film is torn in a controlled manner if the tearing force can be directed to the direction of the desired tearing line. However, if the tearing force deviates from the desired longitudinal tearing line, the film tends to resist tearing and appears very tough.

It is also known to make perforations to a package film material for controlling the tearing open of the package. Such a perforation can be prepared for example by a laser and mechanically so that only a part of the film thickness is punctured, so that the barrier properties of the film are maintained. Such perforations control tearing relatively well if the tearing force can be directed along the perforations. However, if the tearing force is directed cross-wise with regard to the perforations, tearing easily departs from the desired path of perforations and becomes uncontrolled.

Packages comprising perforations are more vulnerable to mechanical strain imposed during transport than package made of a uniform film. Particularly pressure variations impose problems, because in low air pressure conditions the package is swollen and easily torn at the perforations.

If a flow wrap package does not comprise any tear control mechanism, it will be demanding for the user to keep the contents under control upon opening the package, particularly if the contents comprise separate parts. Such lack of control upon opening of the package often results in contamination of the contents.

It is an aim of the present invention to overcome at least a part of the disadvantages of the known packages.

SUMMARY OF THE INVENTION

The invention is defined by the features of the independent claims. Some specific embodiments are defined in the dependent claims.

According to a first aspect of the present invention, there is provided a package comprising: a sheet made of flexible film material or materials, folded along a longitudinal direction to bring first and second edges of the sheet together, said edges being sealed to form a longitudinal rear seam; a first end of the folded sheet is sealed by a first end seam, and a second end of the folded sheet, located in an opposite end of the folded sheet with respect to the first end, is sealed by a second end seam to form a space for one or more items, wherein said space is defined by said sealed first and second ends and a side wall formed of the folded sheet; an opening initiation point in at least one of the first and second end seams, said opening initiation point configured to provide a point for initiating tearing of the flexible film material to form an opening extending from the first end seam to the second end seam and across the sidewall of the package; at least one tear control element configured to guide tearing initiated from the opening initiation point along a longitudinal direction of the package, from the first end seam to the second end seam and across the sidewall, upon applying a tearing force, said at least one tear control element has been formed into said flexible film material or materials that contribute to the formation of the folded or foldable sheet, and wherein said tearing force is directed towards the tear control element and away from said rear seam.

Various embodiments of the first aspect may comprise at least one feature from the following bulleted list:

- The opening initiation point is located between said rear seam and said tear control element.

Said tearing force acts in a direction which is not parallel to the plane which comprises the longitudinal axis of the package and which plane is orthogonal to the end seams.

Said tearing force is directed approximately transversely to said longitudinal direction of the package.

At least a part of the flexible film material or materials forming or to form the foldable sheet has been modified, for example by a modifying treatment, to create at least one tear control element into the material.

At least a part of the flexible film material forming or to form the foldable sheet has been configured, for example by seam formation, to exhibit at least one tear control element in the sheet or in the ready package.

Said tear control element has been formed to the sheet without adding further strips of the same or different film material and without use of any adhesive or other additives.

Said tear control element is a longitudinal seam in the sheet or a part of it.

The sheet consists of at least two bands of flexible film material joined to each other by longitudinal seams.

At least one of the bands is made from a material that is different from the material of the other bands, said different material preferably being a breathable material.

All bands are made from the same material.

The tear control element is composed of a local discontinuity in the sheet material, preferably said discontinuity being formed by local treatment of the flexible film material of the sheet, such as by a thermal treatment, a mechanical treatment, an ultrasound treatment, a UV light treatment or any combination thereof At least a part of said sheet or bands is made of a breathable material, such as a paper-based material.

The package comprises two tear control elements, each on one side of the package, whereby an entire side of the package is configured to be detached upon tearing open the sidewall from both sides of the package.

The package comprises two tear control elements, whereby an entire side of the package or at least a part of the sidewall of the package is configured to be completely or partly detached upon tearing open of the package so that an opening is produced, wherein said opening has larger dimensions than the corresponding dimensions of a product to be placed inside the package.

Said tear control elements are located at corresponding positions on both sides of the package and on the same side of the rear seam, extending from substantially the same point in the first end seam or from two points in close vicinity of each other in the first end seam, so that the elements are substantially congruent.

Said one or more items in the formed space are disposable laboratory consumables, such as one or more pipette tip racks or a stack of such racks.

According to a second aspect of the present invention, there is provided a method for preparing a package according to the first aspect, the method comprising: folding a sheet of flexible film material along a longitudinal direction to bring first and second edges of the sheet together, and sealing said edges to form a longitudinal rear seam; sealing a first end of the folded sheet by a first end seam, and sealing a second end of the folded sheet, located in an opposite end of the folded sheet with respect to the first end, by a second end seam to form a space for one or more items, wherein said space is defined by said sealed first and second ends and a side wall formed of the folded sheet; providing an opening initiation point in at least one of the first and second end seams, said opening initiation point configured to provide a point for initiating tearing of the flexible film material to form an opening extending from the first end seam to the second end seam and across the sidewall of the package; providing at least one tear control element configured to guide tearing initiated from the opening initiation point along a longitudinal direction of the package, from the first end seam to the second end seam and across the sidewall, upon applying a tearing force, said at least one tear control element has been formed into said flexible film material or materials that contribute to the formation of the folded or foldable sheet, and wherein said tearing force is directed towards a tear control element and away from said rear seam.

Various embodiments of the second aspect may comprise at least one feature from the following bulleted list:

Said tear control element is formed by preparing a longitudinal seam in the flexible film material.

The tear control element is formed by local treatment of the flexible film material of the sheet, such as by a thermal treatment, a mechanical treatment, an ultrasound treatment, a UV light treatment or any combination thereof.

The tear control element is a locally treated region having an elongated shape that extends from the first end seam to the second end seam.

The method comprises joining at least two bands of flexible film material to each other by longitudinal seams to form said sheet.

Disposable laboratory consumables, such as pipette tips in a rack, are placed in said formed space.

A flow wrap process is used for preparing the package, and wherein at least two bands of flexible film material are fed to the process and joined by longitudinal seams to form the folded sheet.

Advantages of the Invention

The core of the invention lies in the provision of control to the opening event of the package by tearing, particularly when using forces that are transverse to the desired tearing line or at least deviate from the desired tearing line. The control is realized by preparing a longitudinal zone or seam to the package film material, which zone or seam exhibits mechanical properties that differ from those of the areas surrounding said zone or seam. In this way, when a tearing force is applied towards said zone or seam, the tearing takes place along the longitudinal direction that is the desired tearing line.

The present invention enables reliable barrier properties of a package, particularly a barrier against contaminating particles and microbes.

The present invention provides an easily openable package.

The present invention is particularly advantageous in packaging pipette tips for use in automated liquid handling devices. In such applications, the user manually opens tip packages and loads the tips into a liquid handling device. By means of the present invention, the manual opening action can be performed in a controlled manner and with a lowered contamination risk.

The present invention decreases manufacturing steps and saves film material. The manufacturing process of the present package is facile and quick. Separate tear strips need not be attached. The use of such strips or adhesives or other chemicals always involves a contamination risk, which can now be avoided by means of the present invention.

EMBODIMENTS

Figure 1A:
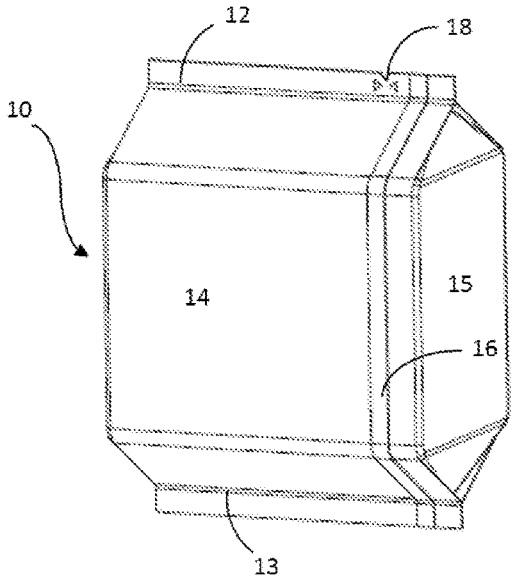
FIGS. 1A to 1F show perspective illustrations of a package in accordance with an embodiment of the present invention, in a closed configuration.

The present invention provides a solution to store items at a controlled purity level inside a flexible plastic package and to manually open the package controllably and with minimal interference to the purity level of the items.

The present invention facilitates opening of the package and provides a good user experience. The package can be reliably opened by a single tearing action, and as a result of the tearing, the package becomes opened to the desired extent.

The present invention provides an advantageous opening mechanism for flow wrap packages that exhibit reliable barrier properties.

Embodiments of the present technology provide for the prevention of a situation in which only a small part of the package becomes torn off, for example only a corner. Advantageously, the present opening mechanism can ensure that tearing proceeds from one end seam to the other end seam along a substantially straight tearing line.

In preferred embodiments, the direction of the tearing force deviates from or is not parallel to the longitudinal direction of the package, such as the direction of the longitudinal rear seam or the longitudinal axis of the package, in the three-dimensional space. For example, the deviation may be at least 10°. In one embodiment, the deviation may be up to 90°.

In one embodiment, the tearing force direction forms an angle of 50 to 90°, more preferably 80 to 90° with regard to the desired tearing line.

In one embodiment, said tearing force acts in a direction which is not parallel to the plane which comprises the longitudinal axis of the package and which plane is orthogonal to the end seams.

The package material may be made of a plastic film, a paper-based film material, Tyvek or any other material that is suitable for a flow wrap process. Preferably, the package material consists of a flexible film.

Preferably, the flexible film material itself is capable of protecting the contents of the package from contamination. In this way the use of any further protective packaging material is avoided.

Preferably, the flexible film material of the sheet is non-shrinkable, even upon heating.

Preferably, the flexible film material does not comprise any holes or perforations extending through the material before manufacturing of the package. Such holes or perforations would be vulnerable to mechanical strain imposed during transport.

Preferably, the flexible film material is not a shrinkwrap film.

An exemplary package structure and a method for preparing the package are explained in the following:

First, a sheet of flexible film material is folded along a longitudinal direction to bring first and second edges of the sheet together, and sealing said edges to form a longitudinal rear seam. Then, a first end of the folded sheet is sealed by a first end seam, and a second end of the folded sheet, located in an opposite end of the folded sheet with respect to the first end, is sealed by a second end seam to form a space for one or more items. The first and second end seams are horizontal, i.e. substantially perpendicular to the rear seam and the longitudinal axis of the package. Said space is defined by said sealed first and second ends and a side wall formed of the folded sheet. The longitudinal sides of the package do not comprise side seams; the package materials merely folds there.

An opening initiation point is provided in at least one of the first and second end seams, said opening initiation point being configured to provide a point for initiating tearing of the flexible film material to form an opening extending from the first end seam to the second end seam and across the sidewall of the package. The package thus becomes opened from side by detaching a part of the sheet by tearing in a longitudinal direction.

The opening initiation point can be formed at any stage during forming the package around an item or items.

The package comprises at least one tear control element configured to guide tearing initiated from the opening initiation point along a longitudinal direction of the package, from the first end seam to the second end seam and across the sidewall, upon applying a tearing force, wherein said tear control element is made of said flexible film material of the sheet.

In some embodiments, the opening initiation point is a notch or a printed mark.

Preferably, the opening initiation point indicates a preferred point in the first end seam for initiating tearing.

In one embodiment, at least one tear control element has been formed into said flexible film material or materials that contribute to the formation of the folded or foldable sheet.

In one embodiment, at least one tear control element has been formed by treating a part of said flexible film material or materials forming or to form the sheet. Such treating may comprise altering the tearability of the film material, in particular increasing tearability thereof. In one embodiment, there is formed a seam.

In one embodiment, at least a part of the flexible film material or materials forming or to form the foldable sheet has been modified to create at least one tear control element into the material. Such modification may imply that at least a part of the foldable sheet has undergone a modifying treatment.

In one embodiment, at least a part of the flexible film material forming or to form the foldable sheet has been configured to exhibit at least one tear control element in the sheet or in the ready package. Such configuration may involve for example seam formation.

In one embodiment, the tear control element or elements are not in a form of an attachable element distinct from the foldable sheet forming the package. For example, the tear control element is not in a form of a strip made of a distinct film in comparison to the film forming the foldable sheet.

Preferably, said tear control element is a longitudinal seam in the sheet.

In some embodiments, the tear control element is a longitudinal seam in the flexible film material or a part of it.

In other embodiments, the tear control element is formed by local treatment of the flexible film material of the sheet. Said local treatment may be a thermal treatment, a mechanical treatment, an ultrasound treatment, a UV light treatment or any combination thereof. Said local treatment may comprise any method by which tearing properties of the flexible film material can be altered, preferably making it more resistant to tearing.

In some embodiments, the tear control element is formed without attaching any external material, such as a ribbon or a tear strip, onto the sheet forming the package.

In some embodiments, the tear control element is formed without attaching any adhesive or material distinct or separate from the material foldable to form the package onto the sheet forming the package.

In a preferred embodiment, the opening initiation point is located between the rear seam and the seam or zone functioning as the tear control element, and the tearing force is directed away from the rear seam.

Preferably, the tear control element is configured to divide the package into two parts, preferably in a ratio in the range of 10:90 to 40:60.

Preferably, as a result of tearing open of the package, the product inside the package can be removed without any hindrance imposed by the folded film material of the package. Therefore it is advantageous to produce, by means of said tearing, such an opening to the sidewall of the package that has larger dimensions than the corresponding dimensions of the product inside the package.

In one embodiment at least two bands of flexible film material are joined to each other by longitudinal seams to form said sheet.

In one embodiment, three bands of flexible film material are joined to each other by longitudinal seams to form said sheet. Said longitudinal seams comprise a longitudinal rear seam, and two further longitudinal seams that function as two tear control elements, one on each side of the package. Preferably said tear control elements are congruent and extend from the same point in an end seam.

In one embodiment, three bands of flexible film material are joined to each other by longitudinal seams to form said sheet. Preferably, the middle band is formed of a breathable material and configured to be torn off when opening the package.

In one embodiment, at least one of the bands is made from a material that is different from the material of the other bands.

In one embodiment, at least a part of a longitudinal seam between two bands of flexible film material forms a tear control element.

In some embodiments, at least a part of the sheet, for example one of the bands or a part of it, is made of a breathable material, such as a paper-based material or Tyvek or a porous material.

A breathable package, or a package comprising breathable material, brings substantial advantages as it reduces transport strain on the package upon fluctuation of ambient pressure and/or temperature, such as during air transport or radiation sterilization.

A breathable package material also makes it possible to perform gas sterilization of the products in the package.

In the present context, the term "breathable material" means that air can pass through the breathable material while simultaneously contaminating particles and like are filtrated and prevented from passing through the breathable material.

The breathable material shall preferably have sufficient filtering properties so that the purity of the products is not impaired. Suitable breathable materials with good filtering properties include Tyvek and medical grade papers.

Tyvek is an advantageous material as it provides a sufficient barrier to prevent contamination of the items in the package while still preventing the package from swelling, as Tyvek is a breathable material. Tyvek comprises HDPE fibres. Its porous fiber structure enables gases and vapours that are used in sterilization to pass through the material while the material still provides a good microbial barrier.

In one embodiment, disposable laboratory consumables, such as pipette tips in a rack, are packaged in the package. Other consumables that could be stored in the package according to the present invention include microwell plates, microtubes and any other laboratory equipment that needs a purity controlled package.

Preferably, a flow wrap process is used for preparing the package.

Suitable flexible plastic materials include: PE, PP, PET, LDPE, HDPE, polyolefins, PVC, and laminates comprising several different film materials.

In preferred embodiments, at least two elongated bands of flexible film material are joined by longitudinal seams to form a sheet. The sheet is then fed to a flow wrap process to form the package. For example, one band may be formed of a flexible plastic material and the other band of a breathable plastic or paper-based material, such as Tyvek.

Optimally, the tear control element is located in such a way that the band made of a breathable material becomes torn off. This can be realized by using a seam between the breathable material and the other flexible film material of the rest of the package as a tear control element.

Alternatively, the breathable material band and additionally a band of flexible other material of the sheet becomes torn off when tearing the package open.

In a still further alternative, the part that is detached from the package upon tearing it open is made of other than breathable material.

The breathable material areas may have any shape, size or location in the sheet. However, it is preferred that the opening initiation point and the breathable material areas are separated from each other, for example by a longitudinal seam. Preferably the opening initiation point is located outside the breathable material, because paper-based materials and Tyvek do not tear well and may produce dust upon tearing.

In one embodiment, the package comprises two tear control elements, each on one side of the package, whereby an entire side of the package is configured to be detached upon tearing open the sidewall from both sides of the package. Preferably, said side to be detached comprises a breathable material used in forming the foldable sheet of the package.

In one embodiment, the package comprises two tear control elements, and upon tearing along said two tear control elements, an opening is produced to the sidewall of the package. Preferably said opening has larger dimensions than the corresponding dimensions of the product inside the package to enable unhindered removal of the product. The detached or partly detached part of the sidewall preferably comprises or consists of a breathable material.

In one embodiment, said tear control elements are located at corresponding positions on both sides of the package, extending from the same point in the first end seam so that the elements are substantially congruent.

In some embodiments, the preferred manner of tearing is indicated by a printed mark or several printed marks, such as finger-shaped marks, on both sides of an opening initiation point, such as a notch. In this way the user is guided to grab and tear the package in an optimal way.

In one embodiment, at least one of the end seams comprises a shaped edge, such as a notched or zig-zag-shaped edge, along a part of or the entire length of the end seam. The preferred region of the end seam for initiating tearing may be visually indicated by a guiding element, such as a printed mark or marks. On the basis of the guidance, the user is then capable of selecting a particular notch, located within the indicated preferred region, to serve as an opening initiation point.

Figure 1B:
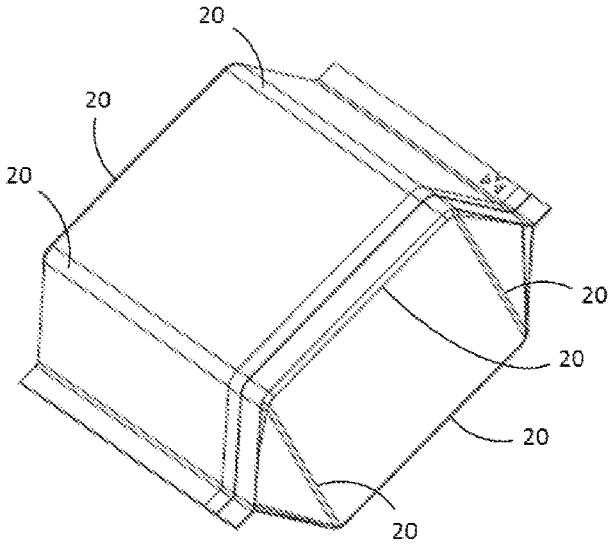
Figure 1C:
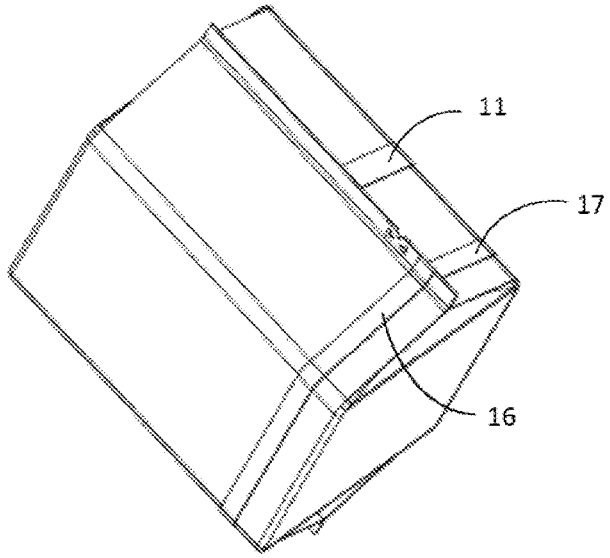
Figure 1D:
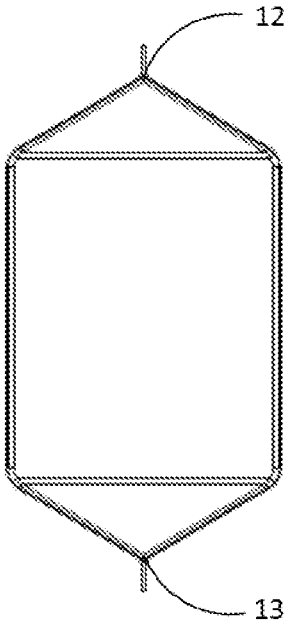
Figure 1E:
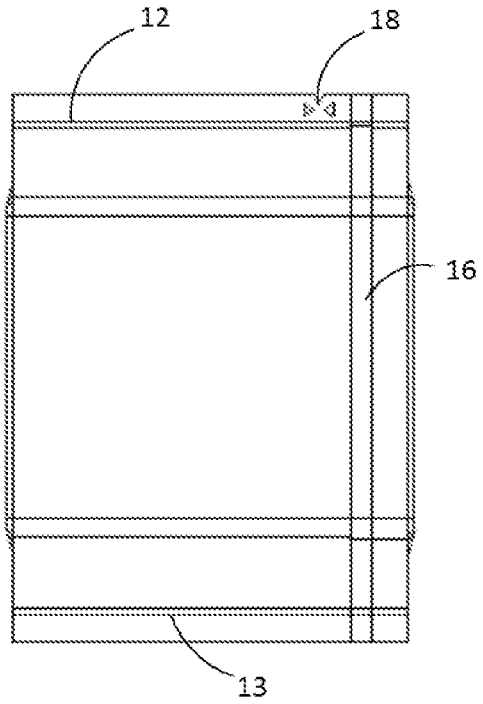
Figure 1F:
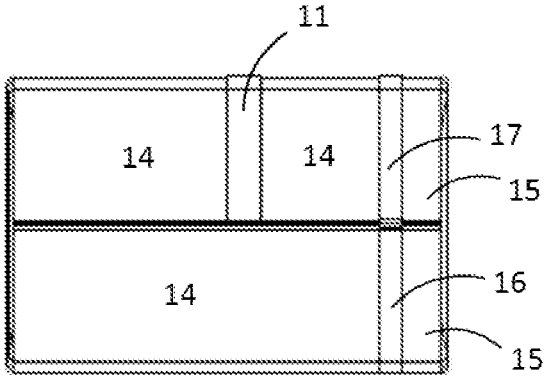

FIGS. 1A to 1F show a flow wrap package 10 according to an embodiment of the present invention in the closed configuration. The package is made of a sheet that has been folded and then closed by a rear seam 11 and two end seams 12, 13. The sheet is formed of two different film materials 14, 15 so that the longitudinal seams 16, 17 joining the films function as tear control elements. In FIG. 1B, some of the folds in the ready package 10 have been depicted by reference signs 20 to better clarify the structure of the package, which comprises both seams and folds.

Figure 2A:
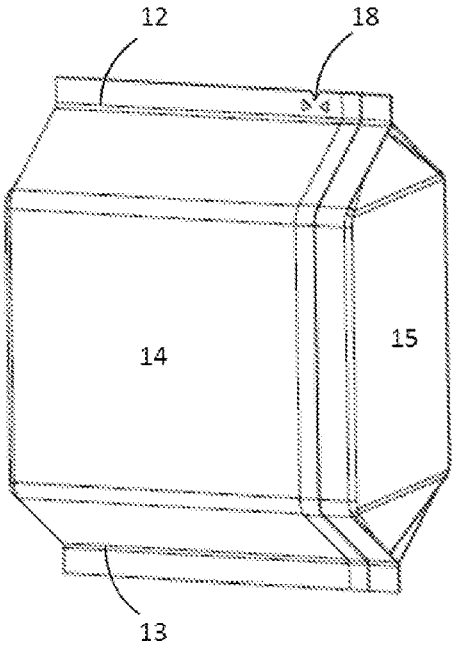
FIGS. 2A to 2C show perspective illustrations of a package in accordance with an embodiment of the present invention, upon opening the package.
Figure 2B:
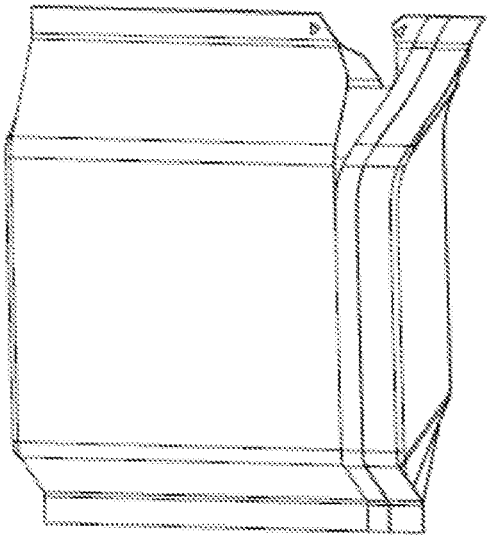
Figure 2C:
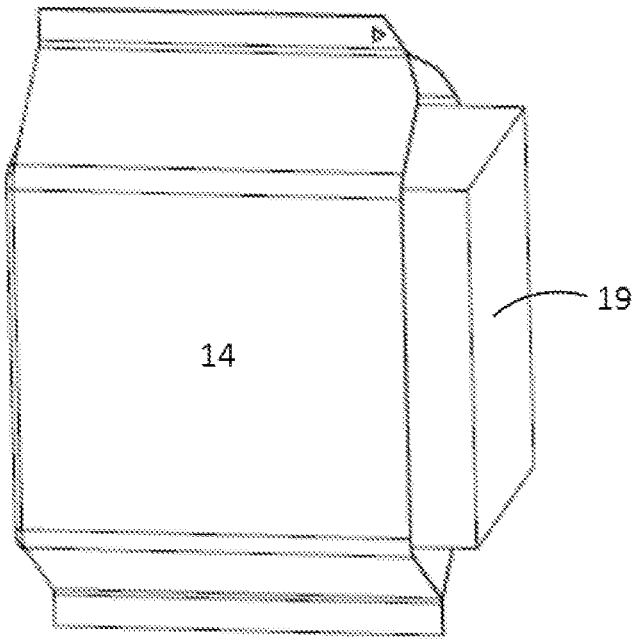
Figure 3A:
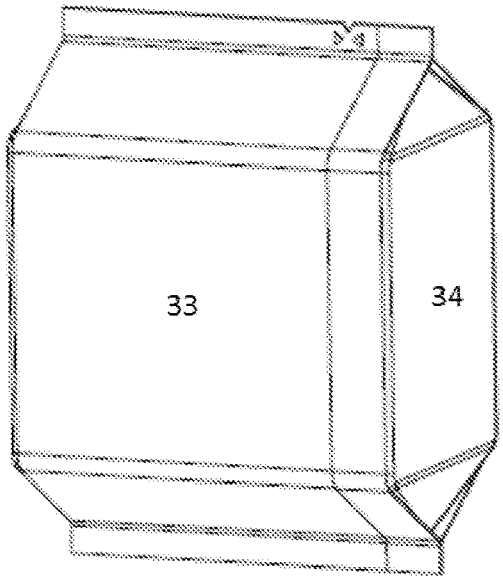
FIGS. 3A to 3D show perspective illustrations of a package in accordance with another embodiment of the present invention, in a closed configuration and upon opening the package.
Figure 3B:
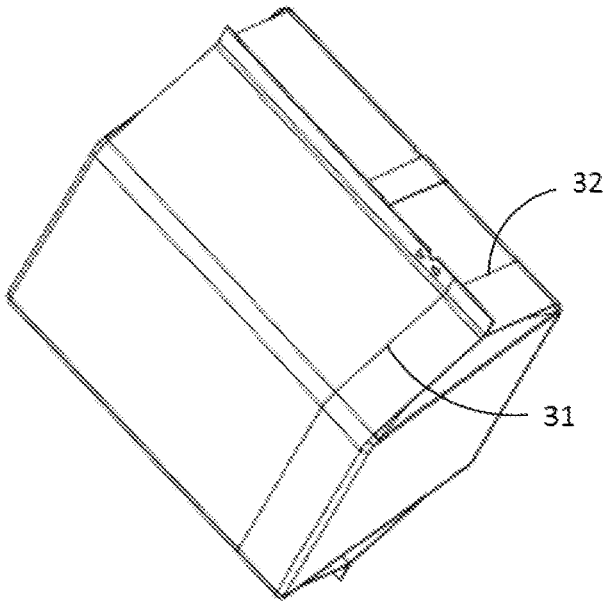
Figure 3C:
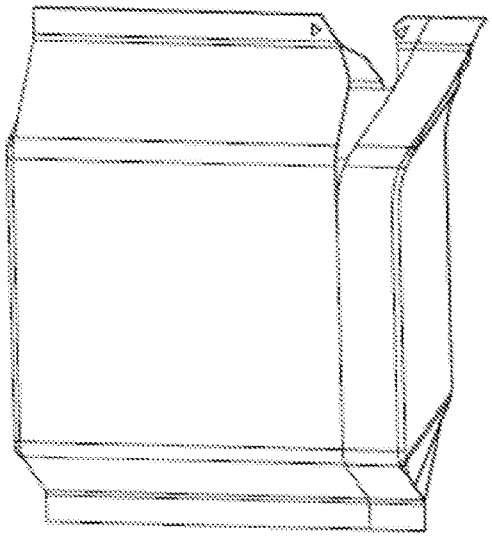
Figure 3D:
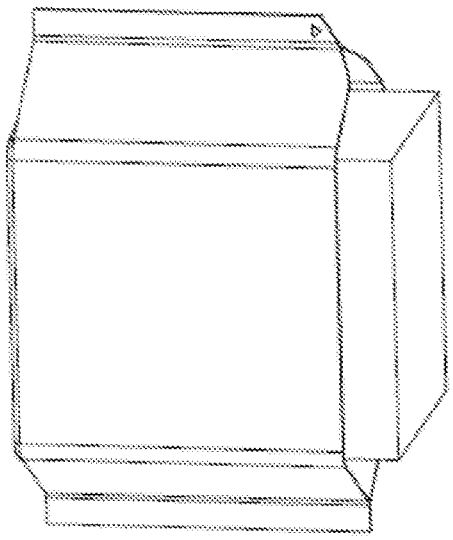

As shown in FIGS. 2A to 2C, when the user starts to tear open the package 10 from the opening initiation point 18 (depicted by two arrows) with a tearing force directed away from the rear seam 11 and towards the longitudinal seams 16, 17, tearing progresses naturally towards one side of the package (the part formed of the film material 15). Once the tearing has proceeded up to the seams 16 and 17 between the two film materials 14, 15, the seams 16 and 17 function as effective tear control and guide elements so that the tearing becomes guided to continue along the seams 16 and 17, longitudinally, towards the opposite end of the package, the end seam 13.

It is desirable to open the entire side of the flow wrap package, from the first end seam 12 to the second end seam 13. The entire part of the package made of the second film material 15 is detached, and the product 19 remains controllably at least partially encased by the first film material 14. Thereafter the product 19, which may be a stack of tip racks, is easy to take out manually, and the opened package does not show any film corners or film folds that might interfere with taking the product out of the package.

FIGS. 3A to 3D show a package in accordance with another embodiment of the present invention, upon opening the package. In this embodiment the tear control elements are depicted by lines 31, 32, which may comprise or delimit for example such locally treated regions of the film material that are more tear-resistant than the surrounding film material. In this embodiment, tearing becomes guided along the lines depicted by the reference signs 31 and 32. The flexible film material 34 that extends between the lines 31 and 32, or at least longitudinal sub-regions adjacent to the lines 31, 32, has preferably been rendered more tear-resistant than the flexible film material 33.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

INDUSTRIAL APPLICABILITY

The present invention is applicable at least in packaging items that require a controlled purity level, such as pipette tips.

ACRONYMS LIST

TFFS Thermoform-Fill-Seal

PE polyethylene

PP polypropylene

PET polyethylene terephthalate

LDPE low-density polyethylene

HDPE high-density polyethylene

PVC polyvinyl chloride

REFERENCE SIGNS LIST

10 package
11 rear seam
12, 13 end seams
14 first film material
15 second film material
16, 17 longitudinal seams
18 opening initiation point
19 product
20 fold
31, 32 tear control elements
33 film material
34 film material

The invention claimed is:

1. A package comprising:

a folded sheet made of flexible film material or materials, folded along a longitudinal direction to bring first and second edges of the sheet together, said edges being sealed to form a longitudinal rear seam;

a first end of the folded sheet being sealed by a first end seam, and a second end of the folded sheet, located in an opposite end of the folded sheet with respect to the first end, being sealed by a second end seam to form a space for one or more items, wherein said space is defined by said sealed first and second ends and a side wall formed of the folded sheet;

an opening initiation point in at least one of the first and second end seams, said opening initiation point configured to provide a point for initiating tearing of the flexible film material or materials to form an opening extending from the first end seam to the second end seam and across the sidewall of the package; and at least one tear control element configured to guide tearing initiated from the opening initiation point along said longitudinal direction of the package, from the first end seam to the second end seam and across the sidewall, upon applying a tearing force, said at least one tear control element being formed into said flexible film material or materials, and wherein said tearing force is directed towards the at least one tear control element and away from said longitudinal rear seam, and wherein the folded sheet comprises at least two bands of flexible film material joined to each other by longitudinal seams.

2. The package according to claim 1, wherein the opening initiation point is located between said longitudinal rear seam and said at least one tear control element.

3. The package according to claim 1, wherein said tearing force is directed approximately transversely to said longitudinal direction of the package.

4. The package according to claim 1, wherein said at least one tear control element has been formed to the sheet without adding further strips of the same or different film material and without use of any adhesive or other additives.

5. The package according to claim 1, wherein said at least one tear control element comprises the longitudinal seams.

6. The package according to claim 1, wherein at least one of the bands is made from a material that is different from the material of the other bands, said different material being a breathable material.

7. The package according to claim 6, wherein at least a part of said folded sheet or at least two bands are made of a breathable material.

8. The package according to claim 1, wherein the at least one tear control element comprises a local discontinuity in the sheet material, said discontinuity being formed by a treatment of the flexible film material or materials of the sheet selected from the group consisting of a thermal treatment, a mechanical treatment, an ultrasound treatment, a UV light treatment, and any combination thereof.

9. The package according to claim 1, wherein the package comprises two tear control elements, wherein an entire side of the package or at least a part of the sidewall of the package is configured to be completely or partly detached upon tearing open of the package so that an opening is produced, and wherein said opening has larger dimensions than the corresponding dimensions of a product to be placed inside the package.

10. The package according to claim 9, wherein said two tear control elements are located at corresponding positions on both sides of the package and on the same side of the rear seam, extending from substantially the same point in the first end seam or from two points in close vicinity of each other in the first end seam so that the elements are substantially congruent.

11. The package according to claim 1, wherein the package encloses disposable laboratory consumables.

12. The package according to claim 11, wherein the disposable laboratory consumables comprise one or more pipette tip racks or a stack of such racks.

13. A method for preparing a package, the method comprising:

folding a sheet of flexible film material along a longitudinal direction to bring first and second edges of the sheet together, and sealing said edges to form a longitudinal rear seam;

sealing a first end of the folded sheet by a first end seam, and sealing a second end of the folded sheet, located in an opposite end of the folded sheet with respect to the first end, by a second end seam to form a space for one or more items, wherein said space is defined by said sealed first and second ends and a side wall formed of the folded sheet;

providing an opening initiation point in at least one of the first and second end seams, said opening initiation point configured to provide a point for initiating tearing of the flexible film material to form an opening extending from the first end seam to the second end seam and across the sidewall of the package; and providing at least one tear control element made of said flexible film material or materials of the sheet and configured to guide tearing initiated from the opening initiation point along said longitudinal direction of the package, from the first end seam to the second end seam and across the sidewall, upon applying a tearing force, wherein said tearing force is directed towards said at least one tear control element and away from said longitudinal rear seam, and wherein the method further comprises joining at least two bands of flexible film material to each other by longitudinal seams to form said sheet.

14. The method according to claim 13, wherein said at least one tear control element comprises the longitudinal seams.

15. The method according to claim 13, wherein the at least one tear control element is formed by a treatment of the flexible film material of the sheet selected from the group consisting of a thermal treatment, a mechanical treatment, an ultrasound treatment, a UV light treatment, and any combination thereof.

16. The method according to claim 13, wherein the tear control element is a locally treated region having an elongated shape that extends from the first end seam to the second end seam.

17. The method according to claim 13, wherein a flow wrap process is used for preparing the package, and wherein at least two bands of flexible film material are first joined by a longitudinal seam to form a sheet, which is fed to the flow wrap process to prepare the package.

18. A package comprising:

a folded sheet made of flexible film material or materials, folded along a longitudinal direction to bring first and second edges of the sheet together, said edges being sealed to form a longitudinal rear seam;

a first end of the folded sheet being sealed by a first end seam, and a second end of the folded sheet, located in an opposite end of the folded sheet with respect to the first end, being sealed by a second end seam to form a space for one or more items, wherein said space is defined by said sealed first and second ends and a side wall formed of the folded sheet;

an opening initiation point in at least one of the first and second end seams, said opening initiation point configured to provide a point for initiating tearing of the flexible film material or materials to form an opening extending from the first end seam to the second end seam and across the sidewall of the package; and at least one tear control element configured to guide tearing initiated from the opening initiation point along said longitudinal direction of the package, from the first end seam to the second end seam and across the sidewall, upon applying a tearing force, said at least one tear control element being formed into said flexible film material or materials, and wherein said tearing force is directed towards the at least one tear control element and away from said longitudinal rear seam, and wherein the at least one tear control element is composed of a local discontinuity in the sheet material, said discontinuity being formed by a treatment of the flexible film material or materials of the sheet selected from the group consisting of a thermal treatment, a mechanical treatment, an ultrasound treatment, a UV light treatment, and any combination thereof.

* * * * *